United States Patent [19]

Miyahara

[11] 4,022,567

[45] May 10, 1977

[54] BURNER FOR BURNING LIQUID FUEL IN GASIFIED FORM

[75] Inventor: Kingo Miyahara, Tokyo, Japan

[73] Assignee: Dowa Co., Ltd, Tokyo, Japan

[22] Filed: Dec. 17, 1975

[21] Appl. No.: 641,761

[30] Foreign Application Priority Data

| | | |
|---|---|---|
| Jan. 15, 1975 | Japan | 50-7353[U] |
| Apr. 21, 1975 | Japan | 50-54291[U] |
| Apr. 21, 1975 | Japan | 50-54292[U] |
| Apr. 25, 1975 | Japan | 50-56639[U] |
| Apr. 25, 1975 | Japan | 50-56640[U] |
| Apr. 21, 1975 | Japan | 50-48326 |

[52] U.S. Cl. ..... 431/168; 239/214.11; 239/214.17

[51] Int. Cl.[2] ..... F23D 11/04

[58] Field of Search ..... 431/168, 169; 239/214.11, 214.17, 222

[56] References Cited

UNITED STATES PATENTS

| | | | |
|---|---|---|---|
| 3,021,892 | 2/1962 | Brola | 431/168 X |
| 3,844,705 | 10/1974 | Miyahara | 431/168 |
| 3,890,086 | 6/1975 | Miyahara | 431/168 |

*Primary Examiner*—Edward G. Favors

*Attorney, Agent, or Firm*—Hill, Gross, Simpson, Van Santen, Steadman, Chiara & Simpson

[57] ABSTRACT

A burner wherein a fuel gasifying member is rotatably mounted in a main body of the burner made of a thin metallic material and receiving an air supply duct inserted through one side, a gasified fuel-air mixing plate for scattering the liquid fuel in atomized particles into said main body is integrally mounted on said fuel gasifying member and a gas wall plate connected at one end to the air supply duct is provided, a swirlingly flowing air film of air blast in the main body of the burner is forcedly circulated to cool said main body from said air supply duct through an air supply opening and along the inner wall surface of said main body, an air shielding wall for preventing the stream of air blast from directly impinging on said main body is disposed in said main body, a combustion plate provided therein with a multitude of gasified fuel blowing openings is disposed in said main body so as to define an annular gasified fuel blowing passageway, an ignition facilitating device is disposed inside of said combustion plate, a hollow conical fuel diffusing member is detachably attached to the inner surface of a fuel gasifying member, a bowl-shaped fuel receiving tray is non-rotatably provided around said fuel diffusing member, and a fuel flow-down plate is provided in sliding contact with said fuel diffusing member. By virtue of the arrangement described above, the burner can achieve a heating effect of high combustion temperature with a lower fuel consumption rate and a longer service life of components.

7 Claims, 16 Drawing Figures

BURNER FOR BURNING LIQUID FUEL IN GASIFIED FORM

This invention relates to a new, useful and improved burner for burning liquid fuel in gasified form, in which said burner can be automatically switched from combustion of the liquid fuel in atomized particles to combustion of the fuel in gasified form.

A main object of the invention is to obtain a burner for burning liquid fuel in gasified form, in which a supply of liquid fuel is blown out and scattered in atomized particles by a fuel gasifying member rotating in a main body of the burner, said scattered fuel is ignited by means of sparks of an ignition plug to instantly initiate combustion of the atomized liquid fuel, then the liquid fuel is caused to diffuse and move along the inner wall surface of the fuel gasifying member in thin film form is quickly vaporized and gasified in the fuel gasifying member, the liquid fuel thus gasified is agitated amd mixed with air blast supplied under pressure to form a perfect gasified fuel-air mixture, which is positively ignited, so that the supply of liquid fuel can be previously prevented from being stagnating in unburned condition, i.e., in fluid form in the main body of the burner and smooth combustion is gasified form can be sustained for a prolonged period of time.

With a burner for burning liquid fuel in gasified from wherein a supply of liquid fuel is scattered into a main body of the burner in atomized particles by means of a rotating fuel gasifying member, said fuel in atomized particles is ignited by means of an ignition plug and thereafter the fuel gasifying member is heated by the flames of combustion of the atomized liquid fuel, and then the liquid fuel supplied in the fuel gasifying member is burned in gasified form, such measure has been taken that a flowing air film is formed along the inner wall surface of the main body of the burner by supplying air blast under pressure for cooling said main body of the burner, so that combustion of the fuel in gasified form in a favorable manner without causing damage to the main body of the burner by the flames of combustion for prolonged period of time, even if said main body of the burner is made of a thin metallic material. However, taking of the above measure can prevent damage caused by the flames of combustion the main body of the burner is cooled by the flowing air film of air blast supplied under pressure, instead, the liquid fuel in atomized particles blown out and scattered toward the inner wall surface of the main body of the burner at the time of ignition and initiation of combustion of the atomized liquid fuel is blown off by the flowing air film of the stream of air blast supplied under pressure and does not stagnate at the position where the sparks of ignition plug take place. For this reason ignition of the fuel and initiation of combustion cannot be smoothly effected, with the result that the scattered fuel in unburned condition is accumulated in the main body of the burner, so that the efficiency of ignition and initiation of combustion of the atomized liquid fuel are lowered and the subsequent combustion of the fuel in gasified form takes place in an unfavorable manner. Such a phenomenon as described above takes places more often in proportion to the quantity of the scattered fuel. Therefore, an object of the invention is to provide a burner for burning liquid fuel in gasified from wherein an air supply duct is inserted in a main body of the burner made of a thin metallic material and opening therein. A fuel gasifying member open at one end thereof is rotatably provided in opposite relation to said air supply duct, a gasified fuel-air mixing plate for scattering the liquid fuel in atomized particles into the main body of the burner is integrally mounted on the opening side of said fuel gasifying member and a gas wall plate connected at one end to the air supply duct is provided between said gasified fuel-air mixing plate and the inner bottom wall of the main body of the burner so as to define a gasified fuel blowing passageway forming an annulus being directed obliquely outwardly between said gasified fuel blowing passageway and the gas wall plate and further air ejection openings connecting at one end to the air supply duct through an air supply opening is defined between the gas wall plate and the inner bottom wall of the main body of the burner, so that a supply of liquid fuel is positively scattered to the stagnating portion in atomized particles for performing combustion of the atomized liquid fuel, the gasified fuel is blown out and burned being directed obliquely outwardly to previously prevent the fuel gasifying member from being heated more than is necessary , and combustion can be effectively facilitated without causing damage to the main body of the burner by the lfames of combustion. The term gas wall plate in this Specification refers to means having a gasified fuel blowing guide side wall and partitioning a gas chamber off an air ejection chamber.

Another main object of the invention is to provide a burner for burning liquid fuel in gasified form wherein the scattered liquid fuel is quickly and positively ignited, combustion of the atomized liquid fuel is initiated and facilitated to thereby permitting combustion of the fuel in gasified form to be sustained in a favorable manner for a prolonged period of time irrespective of the amount of the scattered fuel, even is said burner is of the type which can be switched from combustion of the atomized liquid fuel to combustion of the fuel in gasified form without causing damage by the flames of combustion to the main body of the burner, which is made from a thin metallic material by virtue of forming a swirlingly flowing air film of air blast in the main body of the burner.

A further main object of the invention is to provide a burner for burning liquid fuel in gasified form wherein an air shielding wall for preventing part of stream of air blast blown toward the main body of the burner from directly impinging on said main body is disposed in one portion of said main body with a suitable air circulation passage being formed between said main body and the air shield wall, an ignition facilitating plate is disposed on the upper portion of said air shielding wall intersecting perpendicular to said air shielding wall so as to define an stagnating portion over the ignition facilitating plate for stagnating the turbulent flow caused by impingement action between part of air blast stream and the air shielding wall, and an ignition plug is disposed at the position of said stagnating portion to thereby to instantly ignite the scattered liquid fuel in atomized particles, stabilize and sustain combustion of the gasified fuel, which is initiated.

A still further main object of the invention is to provide a burner for burning liquid fuel in gasified form wherein, even if said burner is of the type in which a combustion plate penetratingly provided on the surface thereof with a multitude of gasified fuel blowing openings is disposed in the main body of the burner so as to define a gas chamber between said main body and the combustion plate whereby the gasified fuel produced in a fuel gasifying member is pressure fed into said gas chamber as being mixed with air blast and is simultaneously blown out through the multitude of gasified fuel blowing openings, ignition of the scattered liquid fuel in atomized particles and initiation of combustion of the atomized liquid fuel are quickly and positively effected and thereafter combustion of the fuel in gasified form in a favorable manner can be sustained by virtue of disposing an ingition facilitating device comprising said air shielding wall, ignition facilitating plate and ingition plug inside of the combustion plate.

A yet further main object of the invention is to provide a burner for burning fuel liquid in gasified form wherein, even if said burner is of the type in which part of air blast can be blown out through said gasified fuel blowing passageway at the time of initiation of combustion of the atomized liquid fuel and the mixture of gasified fuel produced and air blast can be blown out through said gasified fule blowing passageway at the time of combustion of the fuel in gasified form by virtue of disposing the combustion plate in spaced apart relation to the main body of the burner so as to form an annular gasified fuel blowing passageway, an ignition plug provided adjacent to said gasified fuel blowing passageway is previously prevented from being damaged by the flames of combustion during sustained combustion of the fuel in gasified form whereby a favorable ignition and initiation of combustion can take place at any time and ignition and initiation of combustion of the atomized liquid fuel can be instantly carried out.

A further main object of the invention is to provide a burner for burning liquid fuel in gasified form wherein a hollow conical fuel diffusing member is detachably attached to the inner surface of top portion of a fuel gasifying member rotating, whereby a supply of liquid fuel fed from a fuel supply line onto the fuel diffusing member is caused to move into the inner wall surface of the fuel gasifying member uniformly and in diffused form, and then can be scattered uniformly into the main body of the burner in atomized particles through the medium of a fuel scattering surface of the gasified fuel-air mixing plate and more effective combustion of the fuel in gasified form can be effected by minimizing vibration caused to the fuel gasifying member due to rotation thereof.

Moreover, a further main object of the invention is to provide a burner for burning liquid fuel in gasified form wherein a bowl-shaped fuel receiving tray is non-rotatably provided around the outer periphery of said fuel diffusing member and the forward end of the fuel supply line is connected to and open into one side of the fuel receiving tray, so that even a very small amount of liquid fuel can be caused to diffuse and move to the inner surface of the fuel gasifying member.

A further main object of the invention is to provide a burner for burning liquid fuel in gasified form wherein, instead of the above measure in which the liquid fuel is uniformly supplied to the fuel diffusing member, even a very small amount of fuel can be uniformly supplied by virtue of a fuel flow-down plate made of an elastomeric material, which is in sliding contact at one end with the fuel diffusing member and inserted at the other end with the fuel supply line having an opening thereinto.

Additional and other main objects of the invention will become evident from the detailed description set forth hereinafter when considered in conjunction with the accompanying drawings, in which:

FIG. 1 is a longitudinal sectional view, with certain parts being cut out;

FIG. 2 is a plan view of FIG. 1 as viewed from above;

FIG. 3 is a longitudinal sectional view thereof, with certain parts being cut out;

FIG. 4 is an oblique view of FIG. 3, with certain parts being cut out and essential portions of the ignition facilitating device being viewed from right;

FIG. 5 is a longitudinal sectional view thereof, with certain parts being cut out;

FIG. 6 is an oblique view of FIG. 5, with certain parts being cut out and essential portions shown in FIG. 5 being viewed from right;

FIG. 7 is a longitudinal sectional view, thereof, with certain parts being cut out;

FIG. 8 is an oblique view of FIG. 7, with certain parts being cut out and essential portions shown in FIG. 7 being viewed from right;

FIG. 9 is a longitudinal sectional view thereof, with certain parts being cut out;

FIG. 10 is an oblique view of essential portions shown in FIG. 9, with certain parts being cut out;

FIG. 12 is a longitudinal sectional view thereof, with certain parts being cut out;

FIG. 13 is a plan view of FIG. 12 as viewed from above;

FIG. 14 is an oblique view of a modified version of the fuel gasifying member;

FIG. 15 is an enlarged view thereof, with certain parts being cut out; and

FIG. 16 is an oblique view of essential portions of the fuel feed means, with certain parts being cut out.

Figure 1:
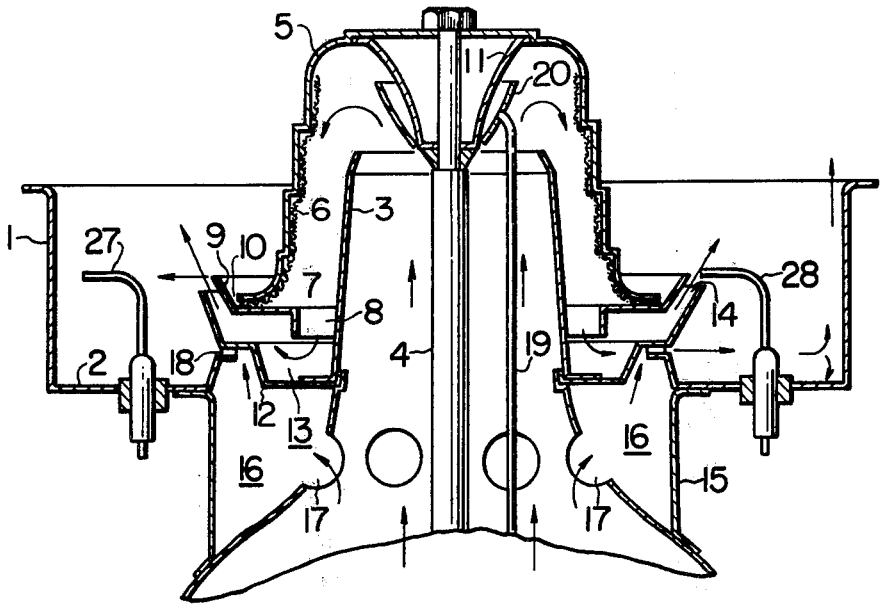
FIGS. 1 and 2 show a first embodiment of the present invention in which the burner for burning liquid fuel in gasified fuel is of the vertical type.
Figure 2:
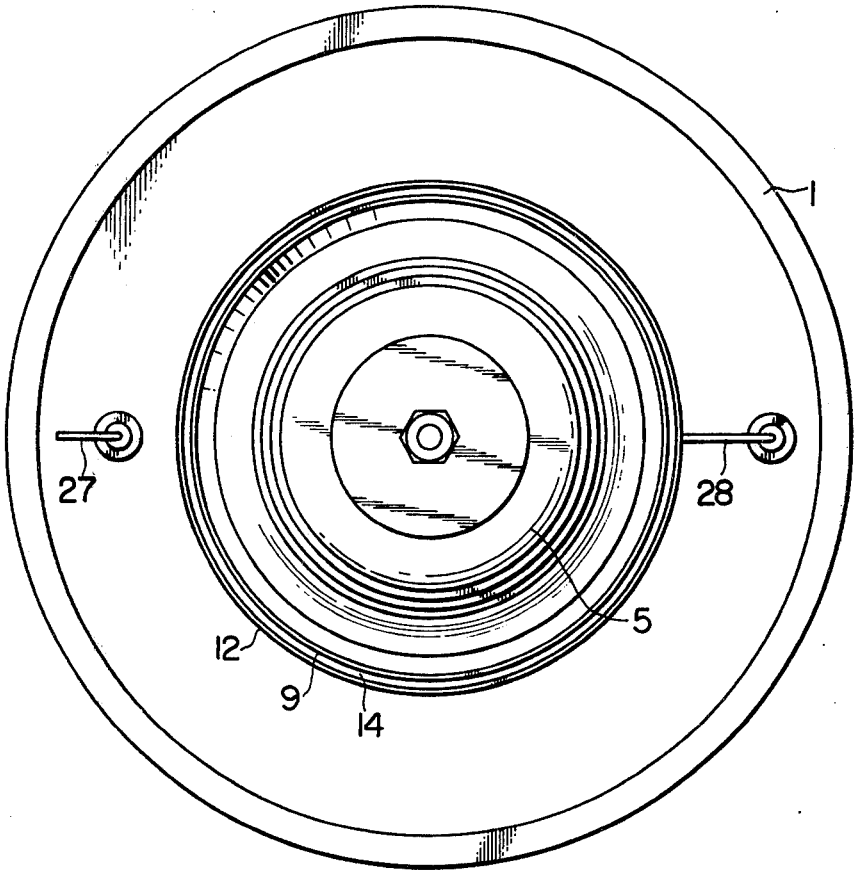

Description will hereunder be given of the construction of the burner for burning liquid fuel in gasified form in the first embodiment shown in FIGS. 1 and 2.

1 refers to a main body of the burner which is open at one end and which receives at the other end an air supply duct 3 longitudinally extending from the inner bottom wall 2 inserted and opening therein, said main body of the burner being made of a thin metallic material such as a sheet metal and said air supply duct 3 being gradually reduced in sectional area inwardly from the open end portion to a certain extent so as to increase the speed of air stream supplied. Said air supply duct 3 receives a rotary shaft 4 whose forward end extends upwardly of the air supply duct 3 inserted therethrough. A substantially cone-shaped fuel gasifying member 5 open at one end is detachably mounted on the forward end of said rotary shaft 4 by means of suitable mounting fittings. Therefore, the air supply duct 3 and the fuel gasifying member 5 are arranged in opposite relation to each other and at the same time the air supply duct 3 is deeply inserted into the fuel gasifying member 5. Said fuel gasifying member 5 has mounted substantially on the entire inner wall surface thereof a flow-down preventing member 6 made of a metallic wire net, and yet a gasified fuel-air mixing plate 7 is provided integrally at the edge of the open end of the fuel gasifying member 5, having said flow-down preventing member 6 interposed therebetween. Said gasified fuel-air mixing plate 7 is provided in the center therof with a gasified fuel-air mixture passage 8 for allowing the gasified fuel and air blast to flow through in mixed condition, and the marginal portion of the gasified fuel-air mixing plate 7 is bent an extended obliquely outwardly so as to form a fuel scattering surface for the liquid fuel. A fuel scattering gap 10 for allowing the liquid fuel to flow out onto the gasified fuel-air mixing plate 7 is formed between the fuel gasifying member 5 and the gasified fuel-air mixing plate 7 by said gasified fuel-air mixing plate 7 being mounted at the edge of the fuel gasifying member 5 through the flow-down preventing member 6. 11 is a hollow fuel diffusing member inwardly fitted into a step portion formed at the top porion of the fuel gasifying member 5. Said fuel diffusing member 11 is in the entire construction thereof formed substantially in the form of an inverted cone and mounted in the inner wall surface of the fuel gasifying member 5 by means of a rotary shaft inserted therethrough. 12 is a gas wall plate interposed between the gasified fuel-air mixing plate 7 and the inner bottom wall 2 of the main body 1 of the burner. Said gas wall plate 12 has its marginal portion bent and extended obliquely upwardly in the same manner as the gasified fuel-air mixing plate 7 does, and yet the base end portion thereof is mounted on the air supply duct 3. As described above, the gas wall plate 12 is disposed directly underneath the gasified fuel-air mixing plate 7 in spaced apart relation with each other. As the result, a gas chamber 13 with a suitable capacity is formed between the gasified fuel-air mixing plate 7 and the gas wall plate 12, an annular gasified fuel blowing passageway 14 having a suitable width is formed at the marginal portion thereof, and the gasified fuel-air mixture produced is vigorously blown out obliquely upwardly. Additionally, an annular air ejection chamber 16 is formed by a wall cylinder 15 spreadingly provided between the inner bottom wall 2 of the main body of the burner and the air supply duct 3 directly underneath said gas chamber 13, more specifically, direct underneath said gas chamber 13 and around the Air supply duct 3. Said air ejection chamber 16 is connected to an air supply opening 17 open to the outer periphery of the air supply duct 3 so as to introduce thereinto part of air blast, which is vigorously blown out toward the main body 1 of the burner through the annular air ejection openings 18 having a suitable width formed between the inner bottom wall 2 and the gas wall plate 12, so that a flowing air film flowing along the inner wall of the main body 1 of the burner to thereby facilitate the cooling action for the main body 1 of the burner and combustion. 19 is a fuel supply line for uniformly supplying liquid fuel onto the surface of the fuel diffusing member 11. The forward end of said fuel supply line 19 is inserted into and open to a fuel receiving tray 20 non-rotatably provided around the outer periphery of the fuel diffusing member 11, so that even a very small amount of liquid fuel can be supplied into the fuel diffusing member 11 in uniform condition. 27 is an ignition plug for performing combustion of the atomized liquid fuel and provided adjacent to the inner surface of the main body of the burner. Additionally, 28 is an ignition plug for performing combustion of the fuel in gasified form and provided adjacent to the open end portion of the gasified fuel blowing passageway 14.

In the burner for burning liquid fuel in gasified form constituting the first embodiment described above, when a stream of air blast is supplied through the air supply duct 3 under pressure and at the same time the fuel gasifying member 5 is rotated, said stream of air blast passes through the rotating fuel gasifying member 5 and is vigorously blown out through the gasified fuel blowing passage 14 obliquely outwardly. On the other hand, part of air blast flowing through the air supply duct 3 flows through an air supply opening 17 into the air ejection chamber 16, is blown out in an annular form through an air ejection opening 18 into the main body 1 of the burner, and ejected upwardly producing a flowing air film of a certain thickness in the main body 1 of the burner. Then, is a supply of liquid fuel is fed from the fuel supply line 19 into the fuel receiving tray 20, the fuel is caused to move along the surface of the fuel diffusing member 11 in diffused form through the agency of surface tension and is supplied to the inner wall surface of the fuel gasifying member 5. The fuel is diffused in a thin film form through the agency of diffusing action of the flow-down preventing member 6 and blast diffusing action of the stream of air blast supplied under pressure during its move along the inner wall surface of the fuel gasifying member 5, flows through the fuel scattering gap 10, is blown out and scattered in atomized particles through the fuel scattering surface 9 provided at the marginal portion of the gasified fuel-air mixing plate 7 into the main body 1 of the burner, ignited by means of an ignition plug 27 to cause combustion of the atomized liquid fuel, and heats the fuel gasifying member 5 intensely, so that the temperature in the interior of the fuel gasifying member 5 is quickly raised to a fuel gasifying atmosphere level. Therefore, thereafter the liquid fuel moves onto the inner wall surface of the fuel gasifying member 5, after having passing through the fuel supply line 19, the fuel receiving tray 20 and the fuel diffusing member 11, is quickly gasified as being caused to diffuse and move in a thin film form and turned into gasified fuel. The fuel thus gasified is mixed with the stream of air blast supplied under pressure and flows into the gas chamber 13, is vigorously blown out obliquely upwardly through the annualr gasified fuel blowing passageway 14, quickly ignited and initiates combustion, and sustains combustion more and more effectively by virtue of supplying action of the flowing air film flowing through the main body 1 of the burner. On the other hand, the main body 1 of the burner is cooled by means of the flowing air film of the stream of air blast supplied under pressure and hence combustion can take place without causing damage to the fuel gasifying member 5 by the flames of combustion however high the temperature of combustion may be.

As described above, by use of the burner for burning liquid fuel in gasified form constituting the first embodiment shown in FIGS. 1 and 2, there can be accomplished a burner device of simplified construction wherein said burner device can be automatically switched from combustion of the atomized liquid fuel to combustion of the fuel in gasified form with very low fuel consumption rate and yet heating combustion flames of high temperature can be obtained, and effective combustion of the gasified fuel can be sustained for a prolonged period of time by virtue of producing a flowing air film, even with the main body of the burner, which is made of a thin metallic material. However, if the flow rate of the flowing air film is excessively raised, then the fuel scattered onto the inner wall surface of the body 1 of the burner by means of the gasified fuel-air mixing plate 7 is blown off upwardly of the position where the ignition plug 27 is provided, thereby causing ignition failure.

Figure 3:
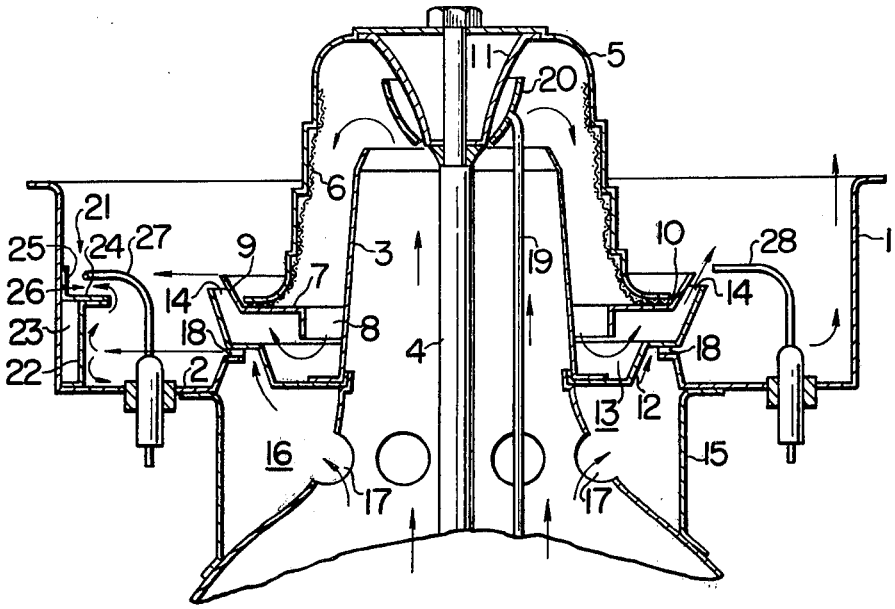
FIGS. 3 and 4 show a second embodiment of the present invention in which an ignition facilitating device is provided on the burner for burning liquid fuel in gasified form of the first embodiment, so that ignition and initiation of combustion of the atomized liquid fuel can take place positively.
Figure 4:
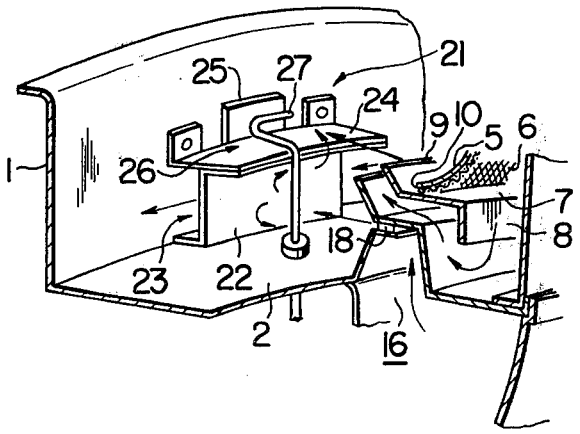

The burner for burning liquid fuel in gasified form wherein ignition and initiation of the liquid fuel in atomized particles takes place positively in such a case as described above is one according to the second invention described in FIGS. 3 and 4.

Referring to the burner according to the second invention, the basic form can be readily accomplished by use of the burner according to the first invention and is concerned to with and ignition facilitating device provided at one side in the main body 1 of the burner of the burner device constituting the first embodiment described in FIGS. 3 and 4. Said device 21 is of the following construction. An air shielding wall 22 for preventing the stream of air blast ejected from air ejection openings 18 toward the main body 1 of the burner from directly impinging on said main body 1 is uprightly provided at a suitable position inside of said main body 1 so as to define an air circulation passage 23 between said main body 1 and said air shielding wall 22. An ignition facilitating plate 24 having a spark plate 25 is horizontally, inwardly projectingly provided on the upper portion of said air shielding wall 22, a stagnating portion 26 for allowing swirls produced through the impingement action between said air shielding wall 22 and the flowing air film of the stream of air blast to be stagnated is provided on the ignition facilitating plate 24, and the ignition plug 27 is provided where the stagnating portion 26 is diposed in opposite relation to the spark plate 25. Said spark plate 25 is mounted on the inner wall surface of the main body 1 of the burner and the forward end of the ignition plug 27 is curved so as to substantially correspond to the configuration of the spark plate 25.

In passing, it is highly important to dispose the aforesaid stagnating portion where the fuel is scattered in order to positively perform ignition and initiation of combustion.

In the burner for burning liquid fuel in gasified fo m constructed as aforementioned, when a stream of air blast is supplied through the air supply duct 3 under pressure and at the same time the fuel gasifying member 5 is rotated, said stream of air blast passes through the rotating fuel gasifying member 5 and is vigorously blown out through the gasified fuel blowing passage 14 obliquely outwardly. On the other hand, part of air blast flowing through the air supply duct 3 flows through an air supply opening 17 into the air ejection chamber 16, is blown out in an annular form through an air ejection opening 18 into the main body 1 of the burner, and ejected upwardly producing a flowing air film of a certain thickness along the wall surface of the main body 1 of the burner, while said flowing air film flows upwardly swirling through the agency of the rotating action of the fuel gasifying member 5. Now, the air shielding wall 22 is disposed with the air circulation passage 23 between at a portion of the main body 1 of the burner, more specifically, where the ignition plug 27 is provided and hence part of the stream of air blast which is blown out impinges on said air shielding wall 22, turns into turbulent flow condition, then into perfect swirls by means of the ignition facilitating plate 24 and is accumulated at the stagnating portion 26. Then, if a supply of liquid fuel is fed from the fuel supply line 19 into the fuel receiving tray 20, the fuel is caused to move along the surface of the fuel diffusing member 11 in diffused form through the agency of surface tension and is supplied to the inner wall surface of the fuel gasifying member 5. The fuel is caused to diffuse in a thin film form through the agency of diffusing action of the flow-down preventing member 6 and blast diffusing action of the stream of air blast supplied under pressure during its move along the inner wall surface of the fuel gasifying member 5, flows through the fuel scattering gap 10, is blown out and scattered in atomized particles through the scattering surface 9 provided at the marginal portion of the gasified fuel-air mixing plate 7 into the main body 1 of the burner. Then, part of the fuel thus scattered is moved by the turbulent flow being stagnated in swirling condition at the stagnating portion 26 and also is stagnated thereat, while the fuel is quickly ignited by sparks sparked between the ignition plug 27 and the spark plate 25 and combustion is initiated, and at the same time the flames of combustion initiated is circulated by means of the flowing air film circulating through the air circulation passage 23 and hence other fuels scattered are ignited successively in the direction of circulation along the main body 1 of the burner, more specifically, from the left in FIG. 2, and the flames of ignition instantly covers the entire area of said main body 1 for combustion. Thus, the scattered liquid fuel in atomixed particles initiates in the main body 1 of the burner and the temperature in the interior of the fuel gasifying member 5 is quickly raised to a fuel gasifying atmosphere level and hence the liquid fuel supplied thereafter is turned into gasified fuel through agency of heating action as being caused to diffuse and move, forms a gasified fuel-air mixture by being mixed with the stream of air blast supplied under pressure during its flow through the fuel gasifying member 5 and flows into the gas chamber 13 where it is turned into a perfect gasified fuel-air mixture, and then is blown out vigorously through the annular gasified fuel blowing passageway 14 obliquely outwardly, whereby the burner is switched from combustion of the atomized liquid fuel to combustion of the fuel in gasified form. Even after combustion is interrupted, if combustion is initiated while the temperature in the interior of the fuel gasifying member 5 is still maintained at the fuel gasifying atmosphere level, a gasified fuel-air mixture is blown out through the gasified fuel blowing passage 14 from beginning, and ignited by means of the ignition plug 28, so that combustion of the fuel in gasified form can take place in a favorable manner.

Figure 5:
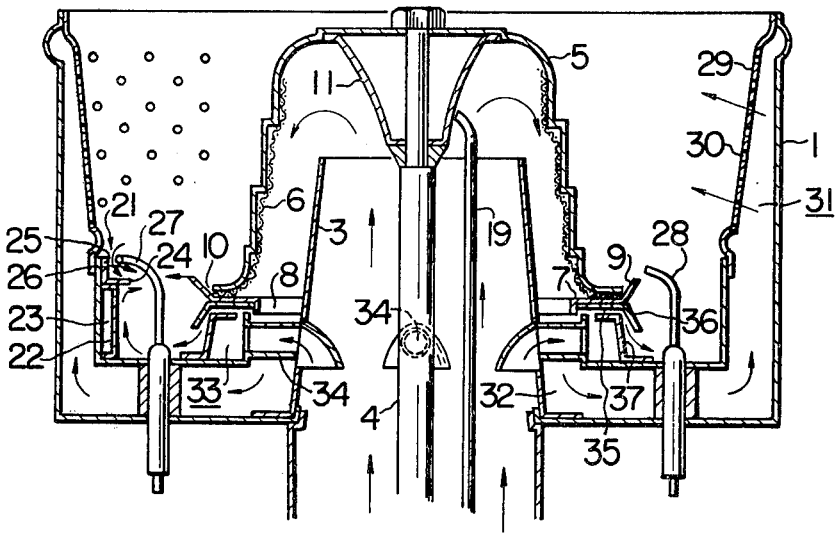
FIGS. 5 and 6 show a third embodiment in which, even if the ignition facilitating device is equipped in a combustion plate disposed so as to form a gas chamber in the main body of the burner and provided therein with a multitude of gasified fuel blowing openings, ignition and initiation of combustion can take place positively.
Figure 6:
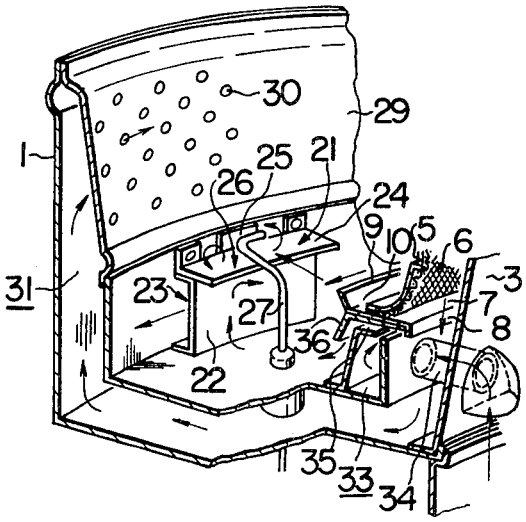
Figure 7:
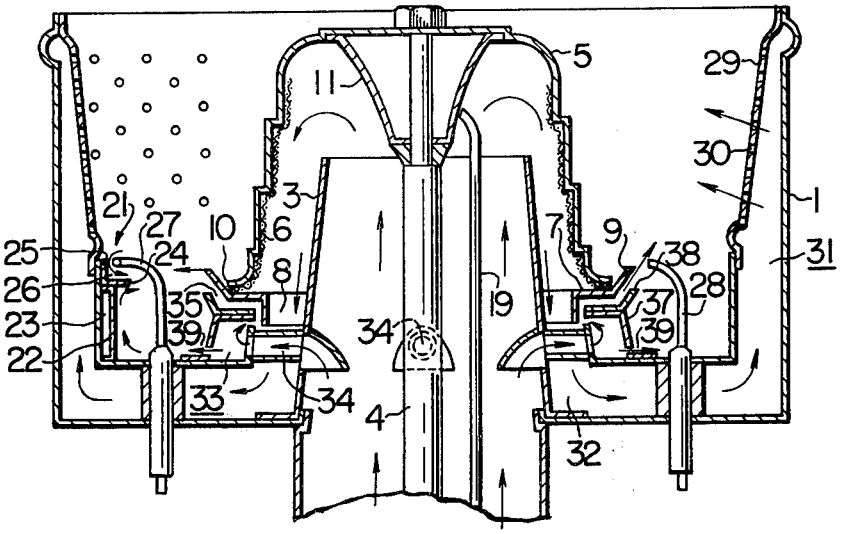
FIGS. 7 and 8 show one embodiment of the invention in which certain parts of the burner shown in the third embodiment above are changed.
Figure 8:
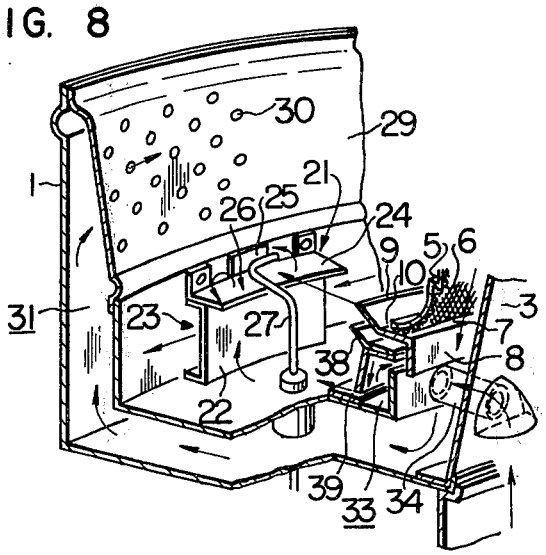

In the burner for burning liquid fuel in gasified form, which is described above, even if the ignition facilitating device 21 is provided in the main body 1 of the burner, which is formed into a simple cylinder and said main body 1 is made of a thin metallic material, the burner is not damaged by flames of combustion at all and can be automatically switched from combustion of the atomized liquid fuel to combustion of the gasified fuel. This can be also applied to the burner for burning liquid fuel in gasified form according to the third invention illustrated in FIGS. 5 and 6, in which initiation of combustion of the atomized liquid fuel is positively and quickly effected and combustion of the fuel in gasified form can be sustained in a favorable manner for a prolonged period of time. In other words, in the burner for burning liquid fuel in gasified form according to the third invention, as shown in FIGS. 5 and 6, an annular combustion plate 29 made of a thin metallic material and penetratingly provided on the upper surface thereof with a multitude of gasified fuel blowing openings 30 is spreadingly provided in the interior of the main body 1 of the burner so as to define a gas chamber 31 between said main body 1 and the annular combustion plate 29, and yet an opening portion 32 open in the center of said gas chamber 31 is maintained in communication with the interior of the rotating fuel gasifying member 5, so that the gasified fuel-air mixture produced is pressure-fed into the gas chamber 31 through the open side of the fuel gasifying member 5 and then ejected and burned through the multitude of gasified fuel blowing openings 30. In order to perform the action described above, in this burner according to the third invention, the gas wall plate 12 provided according to the first invention becomes unnecessary, an air ejection chamber 33 connected at one end to the air supply duct 3 through a plurality of ventilation pipes 34 is annularly provided inside of the wall plate 37 between the gasified fuel-sir mixing plate 7 and the inner bottom wall of the combustion plate 29, part of the stream of air blast supplied under pressure from the air supply duct 3 is ejected to the inner wall surface of the combustion plate 29 through an air ejection opening 35 defined between an air ejection chamber 33 and the gasified fuel-air mixing plate 7, and a flowing air film in swirling condition similar to one in the first invention is produced, so that damages to the inner bottom and inner bottom wall of the combustion plate 29 by the flames of combustion are eliminated and at the same time combustion is facilitated. In order to make the stream of air blast ejected from the air ejection opening to effectively flow and swirl upwardly from the inner bottom wall of the combustion plate 29, a ventilation guide plate 36 in downwardly facing annulus form is provided at the rear side of the gasified fuel-air mixing plate 7 mounted at the edge portion of the fuel gasifying member 5. Additionally, there is no question that in the burner described above, an ignition facilitating device 21 of construction similar to one in the second invention is provided at one side in the combustion plate 29. Additionally, a device is shown in FIGS. 7 and 8, which can produce a flowing air film directed to the interior of the combustion plate 29 in the same manner as described above without using the ventilation guide plate 36 in the above burner according to the third invention. More specifically, the ventilation guide plate 36 in the above burner according to the third invention. More specifically, the ventilation guide plate 36 in downwardly facing annulus form provided at the rear side of the gasified fuel-air mixing plate 7 mounted at the edge portion of the fuel gasifying member 5 is eliminated, in place of the ventilation guide plate 36 an air ejection guide plate 38 having a marginal portion similar to the fuel scattering surface 9 of the gasified fuel-air mixing plate 7, whose marginal portion is bent and extended obliquely outwardly is mounted at the upper end of outer periphery of a wall cylinder 37 of the air ejection chamber 33, the air ejection opening 35 is constructed so as to be directed obliquely upwardly, air ejected from said air ejection opening 35 is blown into the flames of combustion ejected from the gasified fuel blowing openings 30 of the combustion plate 29, to thereby effect combustion in a favorable manner. On the other hand, another air ejection opening 39 is penetratingly provided in a wall plate 37 of the air ejection chamber 33, which is disposed adjacent to the inner bottom side of the combustion plate 29, whereby part of the stream of air blast is turned into a flowing air film directed to the inner wall surface of the combustion plate 29, so that an action similar to one in the third invention described earlier can take place.

Therefore, even with the burner for burning liquid fuel in gasified form of the type in which the combustion plate 29 penetratingly provided therein with a multitude of gasified fuel blowing openings 30 is provided in the main body 1 of the burner so as to define the gas chamber 31 between said main body 1 and the combustion plate 29, not only initiation of combustion of the atomized liquid fuel by use of a supply of fuel can take place instantly by the ignition facilitating device 21, but also a supply of liquid fuel can be automatically gasified after the initiation of combustion of the atomized liquid fuel, so that the gasified fuel-air mixture thus produced can be effectively blown out and burned through the multitude of gasified fuel blowing openings 30.

Additionally, if the burner for burning liquid fuel in gasified form constructed according to the second invention is changed into the burner for burning liquid fuel in gasified form constructed according to the third invention, not only the small-sized main body 1 of the burner can effectively burn the gasified fuel-air mixture in a large volume, but also ignition plugs are previously prevented from damage by the ejected flames of combustion, so that initiation of combustion of the atomized liquid fuel and switching to combustion of the fuel in gasified form can be effected at any time.

In other words, in the burner for burning liquid fuel in gasified form constructed according to the fourth invention described above, a gas wall plate 40 is provided in the main body 1 of the burner through the medium of a cooled air passage 41, and the base end of the cooled air passage 41 is connected to the air supply duct 3 through an air supply opening 42. Said gas wall plate 40 is rendered concave and is mounted at the central portion thereof on the air supply duct 3, and in the gas wall plate 40, an annular combustion plate 45 whose end portions are bent is arranged and supported by means of suitable supports so as to define annular gasified fuel blowing passageways 43, 44 respectively between said gas wall plate 40 and the gasified fuel-air mixing plate 7 mounted on the open end portion of the fuel gasifying member 5 rotatably provided in the main body 1 of the burner, whereby a gas chamber 46 connected to the fuel gasifying member 5 is defined between the gas wall plate 40 and the combustion plate 45. Additionally, said gas wall plate 40 is constructed to be shorter than the main body 1 of the burner, and the forward ends of said main body 1 and gas wall plate 40 are bent inwardly whereby the flames of combustion and the stream of air blast are concentrated to the central portions thereof, so that more effective combustion can take place. An ignition facilitating plate 47 having a spark plate 48 is horizontally, inwardly projectingly, spreadingly provided at a portion of the open end of the gasified fuel blowing passageway 43 defiend between said gas wall plate 40 and the combustion plate 45, so that the gasified fuel blowing passage 43 is partially obstructed, and the spark plate is uprightly mounted in the inner wall surface of the gas wall plate 40. Additionally, the ignition plug 27 is disposed over the ignition facilitating plate 47 in the same manner as in the second invention.

Therefore, in the burner constructed according to the forth invention, when a stream of air blast is pressure-fed into the air supply duct 3, part of the stream of air blast passes through the fuel gasifying member 5 and the gas chamber 46, and is vigorously blown out forwardly through the gasified fuel blowing passageways 43, 44, and the rest of the stream of air blast passes through the air supply openings 42 and the cooled air passage 41, and is blown out forwardly cooling the main body 1 of the burner and the gas wall plate 40. Thus, only the stream of air blast is pressure-fed into the air supply duct 3, passes through the fuel gasifying member 5, and the gas chamber 46. The stream of air blast blown through the gasified fuel blowing passageway 43 is partially obstructed by the ignition facilitating plate 47 and impinges thereon, with the result that the stream of air blast is stagnated over the ignition facilitating plate 47 causing swirling phenomenon. Then, if a supply of liquid fuel is fed from the fuel supply line 19 onto the rotating fuel diffusing member 11, the fuel moves in diffused form to the inner wall surface of the fuel gasifying member 5, then the fuel is caused to move and diffuse in a thin film form through the agency of centrifugal diffusing action of the fuel gasifying member 5, diffusing action of the flow-down preventing member 6 and blast action of the stream of air blast supplied under pressure, and flows through the fuel scattering gap 10 and scattered in atomized particles from around the outer periphery of the gasified fuel-air mixing plate 7 to the gas wall plate 40. Since swirling phenonmenon of the stream of air blast is caused at the position over the ignition facilitating plate 47, where the fuel is to be scattered, said fuel is not scattered and moved by the swirls and is stagnated around the ignition plug 27. Hence said fuel is quickly ignited by sparks, and said initial ignition causes other scattered fuels to be ignited, combustion of the atomized liquid fuel is initiated, and the temperature in the interior of the fuel gasifying member 5 is raised to a fuel gasifying atmosphere level. As a result, thereafter, a supply of liquid fuel fed to the interior of the gasifying member 5 is turned into gasified fuel as being caused to diffuse and move, the resulting gasified fuel is mixed with the stream of air blast to form a perfect gasified fuel-air mixture, and blown out through the gasified fuel blowing passageways 43, 44, to thereby execute combustion of the gasified fuel. Now, even at the time of combustion of the gasified fuel, no gasified fuel-air mixture is ejected from the position where the ignition facilitating plate 47 is provided and hence the ignition plug 27 is not directly exposed to and heated by the flames of combustion of the fuel in gasified form, and combustion of the fuel in gasified form can take place repeatedly without causing damage to the burner by the flames of combustion and moreover the main body 1 of the burner and the gas wall plate 40 are cooled by the flowing stream of air blast, so that such damage can be previously prevented from being caused thereto.

Therefore, when the above-mentioned burner for burning liquid fuel constructed according to the fourth invention is used, even with a small diameter main body of the burner a gasified fuel-air mixture in a large volume can be effectively burned and moreover damage to the ignition plug 27 by the flames of combustion can be eliminated, so that ignition and initiation of combustion of the atomized liquid fuel can be positively and repeatedly performed at any time.

Figure 9:
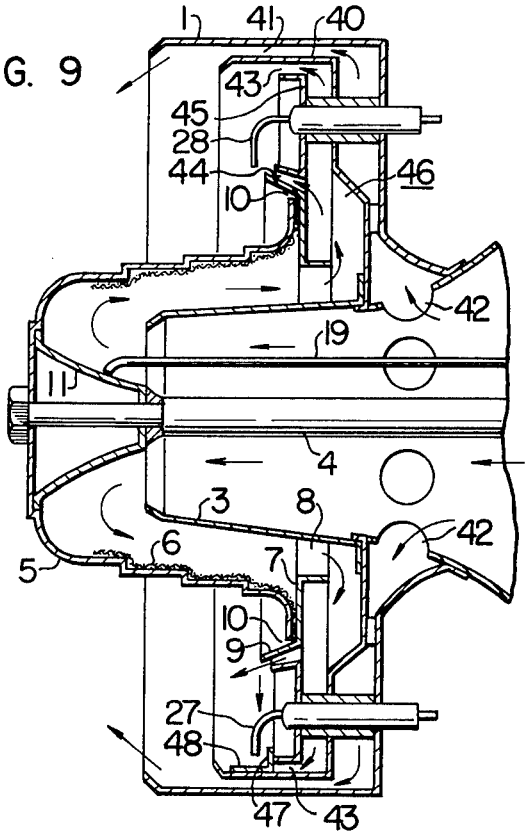
FIGS. 9 and 10 show a fourth embodiment of the invention, in which, even if a plurality of annular gasified fuel blowing passageways are formed in the main body of the burner, ignition and initiation of combustion can take place smoothly and at the same time the ignition plug can be previously prevented from being damaged by the flames of combustion.
Figure 10:
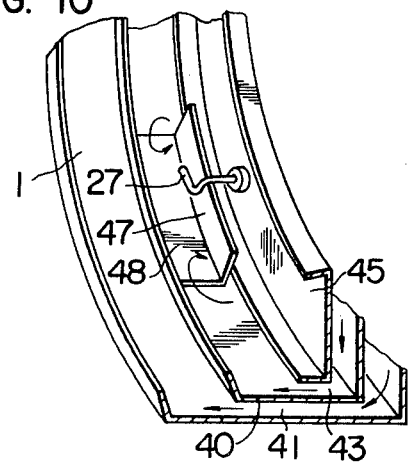
Figure 11:
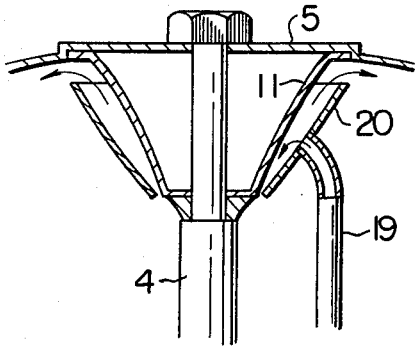
FIG. 11 is an enlarged view of fuel feed means shown in FIG. 1, with certain parts being cut out.
Figure 12:
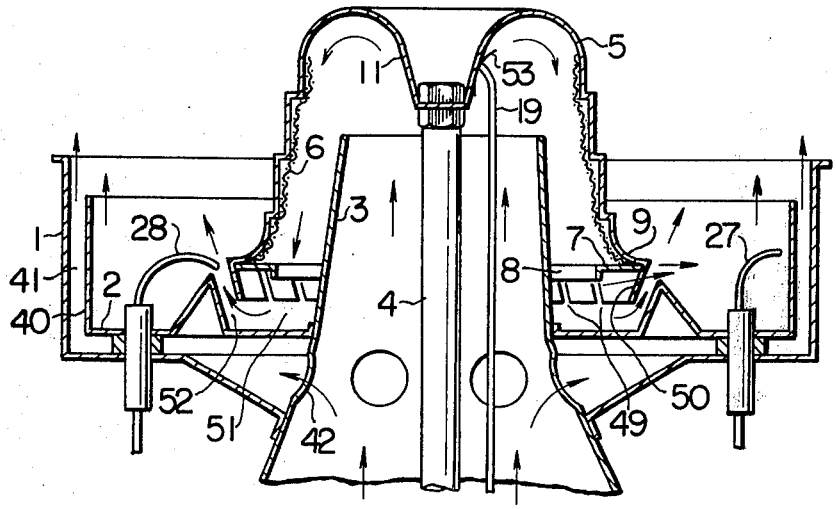
FIGS. 12 through 16 show modified versions of fuel feed means of the first embodiment.
Figure 13:
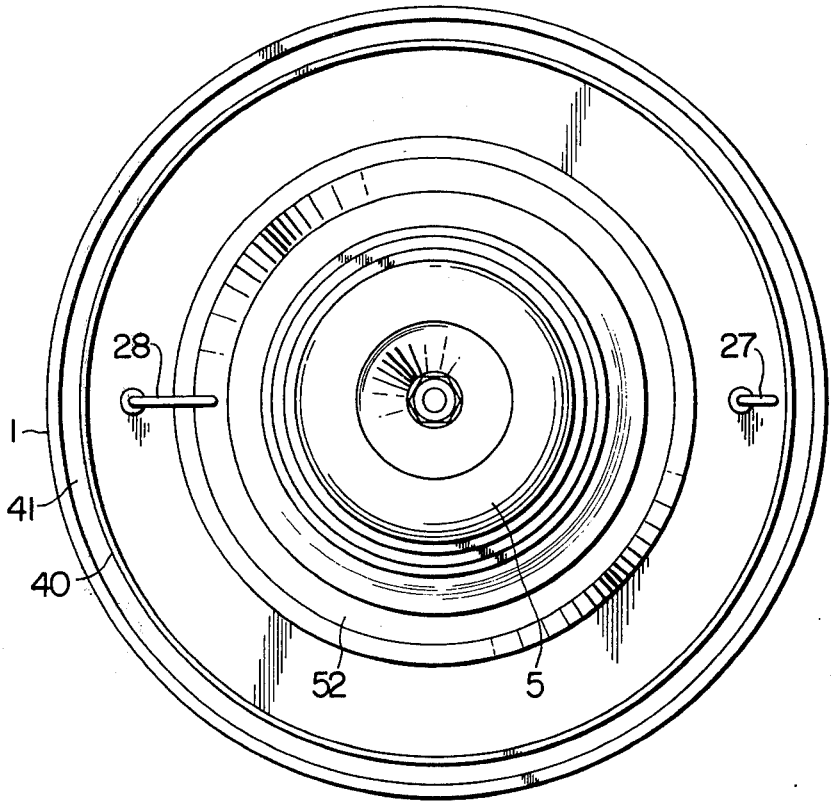
Figure 14:
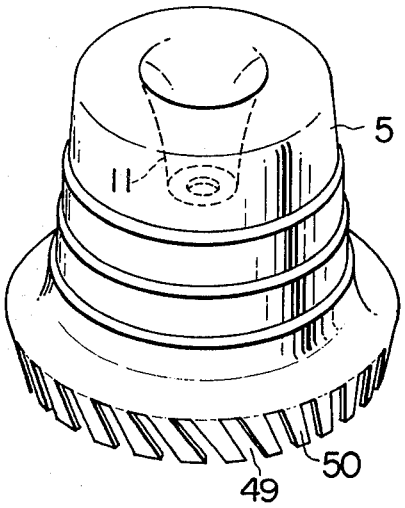
Figure 15:
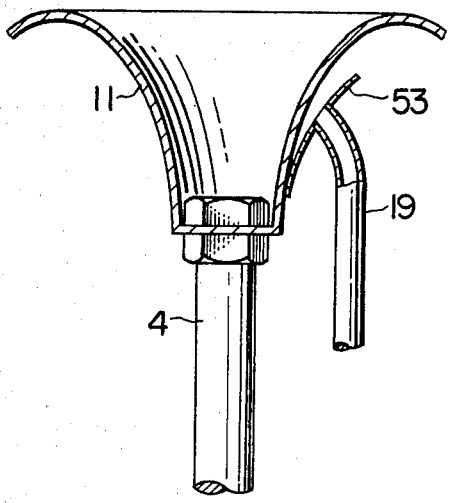
Figure 16:
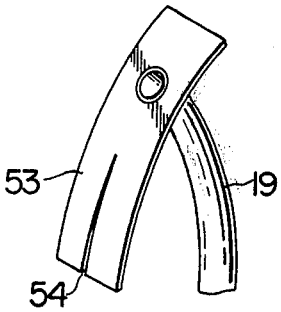

It is highly important for atomization of liquid fuel and production of gasified fuel which follow later at the time of combustion of the atomizded liquid fuel that a supply of liquid fuel is supplied the fuel diffusing member 11 through the fuel supply line 19, caused to diffuse and move in uniform condition to the inner wall surface of the rotary fuel gasifying member 5. That is, in case a supply of liquid fuel is not supplied in uniform condition onto the surface of the fuel diffusing member 11 and to the entire area of the inner wall surface of the fuel gasifying member 5 but supplied unbalancedly, the atomized fuel ejected and scattered from the periphery of the fuel gasifying member 5 to the inner wall surface of the main body 1 of the burner through the agency of centrifugal force lacks uniformity in quantities over the entire area, with the result that much fuel is found in same place but no fuel is found in other place, and such a case may occur that however often the ignition plug 27 may be caused to spark, ignition and initiation of combusion of the atomized liquid fuel cannot take place. Such a phenomenon may not often occur when the supply of liquid fuel is sufficient but is liable to take place when the supply of liquid fuel is controlled to be low so as to perform combustion of a low capacity. In order to minimize the occurrence of such phenomenon, in the burner for burning liquid fuel contructed according to the first invention shown in FIG. 9, a bowl-shaped fuel receiving tray 20 open at the bottom portion thereof is non-rotatably surroundingly provided around the fuel diffusing member 11 inserted into and positioned at the inner surface of top portion of the fuel gasifying member 5 by the tip end of the fuel supply line 19 being inserted into the side of the fuel receiving tray 20 and open therein. Now, a supply of liquid fuel having flowed from the tip end opening portion of the fuel supply line 19, during its flow-down through the fuel receiving tray 20, gets in contact with the side face of the fuel diffusing member 11 rotating at high speed, is scattered in atmozed particles from the outer peripheral surface of the upper portion of the fuel diffusing member through the agency of centrifugal force of the rotating fuel diffusing member 11, and caused to diffuse on the inner wall surface of top portion of the fuel gasifying member 5. Accordingly, the fuel having flowed out from the fuel supply line 19 is reliably poured into the fuel receiving tray 20 irrespective of quantity of the fuel. By this, it is planned to solve the problem. However, solution may be sought through another measure too. In other words, said measure refers to the device of embodiment shown in FIGS. 12 through 16.

In this burner, the fuel diffusing member 11 is integrally provided on the fuel gasifying member 5 by the center of the fuel gasifying member 5 being expanded inwardly and moreover a skirt 50 provided therein with a multitude of blowing slits 49 is inwardly bent and provided integrally with the fuel gasifying member 5 at the open end portion of the fuel gasifying member 5, and said skirt 50 has a lower half portion received in a recess portion 51 provided on the side of the inner bottom wall 2 so as thereby to define a gasified fuel blowing passageway 52 therebetween. A longitudinal fuel flow-down plate 53 made of a elastomeric material and whose free end portion is adapted to abut on the fuel diffusing number 11 is mounted at the forward end of the fuel supply line 19 inserted through the fuel gasifying member 5, so that the liquid fuel supplied from the fuel supply line 19 can constantly flow down said fuel flow-down plate 53 and be fed onto the fuel diffusing member 11. When the burner device of such embodiment is used, even if a supply of liquid fuel is a very small amount, the fuel flows down continuously without flowing down intermittently from the open end portion of the fuel supply line 19 by virtue of that the fuel supply line 19 is connected to the fuel diffusing member 11 through the fuel flow-down plate 53, is caused to diffuse in uniform condition by means of the fuel diffusing member 11, then moved to the inner wall surface of the fuel gasifying member 5, scattered in atomized particles through the blowing slits 49 to the interior of the main body 1 of the burner, combustion of the atomized liquid fuel is performed by igniting the fuel and at the same time the diffused fuel moving along the inner wall surface of the fuel gasifying member 5 is heated and quickly turned into gasified fuel after initiation of combustion of the atomized liquid fuel, the gasified fuel thus produced is mixed with the stream of air blast to form a perfect gasified fuel-air mixture, which is ejected in many directions through the gasified fuel blowing passageway and the blowing slits 49 to thereby effect combustion of the gasified fuel.

Additionally, said fuel flow-down plate 53 is formed at the free end portion thereof with a forked cutout 54, thereby facilitating fuel flow-down.

With the arrangement described above, according to the present invention, a supply of liquid fuel fed from the fuel supply line 19 is caused to move in uniform condition to the interior of the fuel gasifying member 5 by means of the fuel diffusing member 11, then caused to diffuse again into a thin film form by means of the rotating fuel gasifying member 5, scattered in atomized particles through the fuel scattering surface 9 of the gasified fuel-air mixing plate 7 provided at the open end portion of the main body 1 of the burner into said main body 1, ignited to quickly initiate combustion of the atomized liquid fuel, whereby the fuel gasifying member 5 can be heated, and moreover after initiation of combustion of the atomized liquid fuel a supply of liquid fuel is quickly turned into gasified fuel and simultaneously is mixed with the stream of air blast to form a perfect gasified fuel-air mixture, and blown out through the gasified fuel blowing passage obliquely upwardly, whereby combustion of the gasified fuel can be sustained in a favorable manner. Therefore, with the burner for burning liquid fuel in gasified form according to the present invention, the burner can readily be switched from combustion of the atomized liquid fuel to combustion of the fuel in gasified form and hence it is possible for anyone to achieve a heating effect of high combustion temperature with a low fuel consumption rate.

Furthermore, in the burner for burning liquid fuel in gasified form according to the present invention, the ignition facilitating device 21 comprising the air shielding wall 22, the ignition facilitating plate 24, the ignition plug 27 and the like is provided at a portion of the main body 1 of the burner and hence the atomized liquid fuel scattered is not blown off by the flowing air film flowing through the main body 1 of the burner for preventing said main body 1 made of a thin metallic material from being damaged by flames of combustion and therefore ignition and initiation of combustion do not lack smoothness, all of combustion initiating operation is positively and instantly performed, and moreover the aforementioned ignition and initiation of the atomized liquid fuel can be effectively carried out even with the burner for burning liquid fuel in gasified combustion wherein a gas chamber is surroundingly provided along the inner periphery of the main body 1 of the burner.

Still furthermore, the burner for burning liquid fuel in gasified form constructed according to the invention presents such many features that the ignition plug is previously prevented from being damaged by the flames of combustion of the gasified fuel within a short period of time, so that failures in repeated initiations of combustion of the atomized liquid fuel are eliminated and initiation of the atomized liquid fuel in a favorable manner can take place at any time, and even if the supply of fuel is controlled to be a very small amount, said very small amount of fuel is made to be continuously and uniformly fed to the fuel diffusing member 11, so that not only ignition and initiation of combustion of the atomized liquid fuel but also combustion of the fuel in gasified form can be effectively performed even at the time of a fuel supply being made in a small amount.

I claim:

1. A burner for burning liquid fuel in gasified form comprising:

an air supply duct inserted into a main body of the burner and opening therein;

a fuel cone shaped gasifying member rotatably disposed in the main body of the burner and mounted in opposite relation to said air supply duct;

a gasified fuel-air mixing plate having a fuel scattering surface and a gasified fuel air mixture passage, and mounted to the open end portion of said fuel gasifying member to define a liquid fuel scattering gap therebetween;

a gas wall plate interposed between the gasified fuel-air mixing plate and inner bottom wall of the main body;

a gas chamber having a gasified fuel blowing passageway inclined obliquely outwardly and mounted between the gasified fuel-air mixing plate and the gas wall plate and an air ejection chamber connected at one end through air supply openings to the air supply duct is provided between the gas wall plate and the inner bottom wall of the main body of the burner respectively by providing the gas wall plate between said gasified fuel-air mixing plate and an inner bottom wall of the main body of the burner; and air ejection openings open to the interior of the main body of the burner are provided in the air ejection chamber for producing a flowing air film of the stream of an air blast supplied under pressure in the main body of the burner.

2. A burner for burning liquid fuel in gasified form as set forth in claim 1, characterized in that:

an air shielding wall for preventing part of the stream of air blast ejected toward the inner wall of the main body of the burner from directly impinging on the main body of the burner is provided so as to define an air circulation passage between said main body and the air shielding wall;

an ignition facilitating plate is internally projectingly disposed at the upper portion of said air shielding wall so as to form a stagnating portion over the ignition facilitating plate for allowing the turbulent flow produced by impingement action occurred between the air shielding wall and the stream of air blast to stagnate; and an ignition plug is provided at the position of said stagnating portion.

3. A burner for burning liquid fuel in gasified form as set forth in claim 1, characterized in that:

a combustion plate penetratingly provided in the surface thereof with a multitude of gasified fuel blowing openings is provided along the inner periphery of the main body of the burner so as to form a gas chamber; and an ignition facilitating device comprising an air shielding wall, an ignition facilitating plate, an ignition plug and the like is provided at a portion inside of said combustion plate.

4. A burner for burning liquid fuel in gasified form as set forth in claim 1, characterized in that:

a combustion plate is disposed inside of the main body of the burner so as to form a gasified fuel blowing passageway for allowing the stream of air blast and the gasified fuel-air mixture to be blown out therethrough;

an ignition facilitating plate is disposed on said gasified fuel blowing passageway so as to obstruct part of said gasified fuel blowing passageway; and an ignition plug is disposed at the position where obstruction is made by said ignition facilitating plate.

5. A burner for burning liquid fuel in gasified form as set forth in claim 1, characterized in that:

a hollow fuel diffusing member is detachably mounted at the inner surface of top portion of a fuel gasifying member rotatably provided in the main body of the burner.

6. A burner for burning liquid fuel in gasified form as set forth in claim 1, characterized in that:

a fuel gasifying member is rotatably provided in the main body of the burner;

a cup-like fuel receiving tray is nonrotatably surroundingly provided around a fuel diffusing member attachably provided on the inner surface of top portion of said fuel gasifying member; and the forward end of fuel supply line is inserted into one side of said fuel receiving tray and open therein.

7. A burner for burning liquid fuel in gasified form as set forth in claim 1, characterized in that:

a fuel gasifying member is rotatably provided in the main body of the burner; and the free end portion of a fuel flow-down plate mounted at one end on the fuel supply line is in sliding contact with the surface of the fuel diffusing member provided on the inner surface of top portion of said fuel gasifying member.

* * * * *